US009662590B1

(12) United States Patent
Villarreal et al.

(10) Patent No.: US 9,662,590 B1
(45) Date of Patent: May 30, 2017

(54) METHOD AND APPARATUS FOR PROVIDING DISABLED INDIVIDUALS ACCESS TO PLAYGROUND STRUCTURES

(71) Applicants: Olenka Steciw Villarreal, Palo Alto, CA (US); Peter Cassidy Jensen, Santa Monica, CA (US)

(72) Inventors: Olenka Steciw Villarreal, Palo Alto, CA (US); Peter Cassidy Jensen, Santa Monica, CA (US)

(73) Assignee: Magical Bridge Foundation, Palo Alto, CA (US)

( * ) Notice: Subject to any disclaimer, the term of this patent is extended or adjusted under 35 U.S.C. 154(b) by 0 days.

(21) Appl. No.: 14/757,991

(22) Filed: Dec. 23, 2015

Related U.S. Application Data

(63) Continuation-in-part of application No. 29/542,087, filed on Oct. 9, 2015.

(51) Int. Cl.
*A63G 21/04* (2006.01)
*A63G 21/02* (2006.01)
*A63G 21/00* (2006.01)

(52) U.S. Cl.
CPC ..... *A63G 21/02* (2013.01)

(58) Field of Classification Search
CPC . A63G 3/00; A63G 9/00; A63G 21/00; A63G 21/10; A63G 21/18; A63G 31/00; A63B 2208/12; A63B 2009/006; A62B 1/20
USPC ..... 472/116–117; 482/35–36; 182/49
See application file for complete search history.

(56) References Cited

U.S. PATENT DOCUMENTS

| | | | | |
|---|---|---|---|---|
| 260,276 | A | 6/1882 | Bovey | |
| 327,937 | A | 10/1885 | Douglass | |
| 382,619 | A | 5/1888 | Peterson | |
| 2,620,185 | A | 12/1952 | Harding | |
| 3,743,281 | A | 7/1973 | Gimbel | |
| 4,487,411 | A * | 12/1984 | Ahrens | A63G 21/00 472/116 |
| 4,606,431 | A | 8/1986 | Ruder | |
| 4,813,663 | A | 3/1989 | Rice | |
| 4,865,312 | A | 9/1989 | Katz | |
| 5,031,897 | A | 7/1991 | Zalesak | |
| 5,372,550 | A | 12/1994 | Gleeson et al. | |
| 5,427,574 | A | 6/1995 | Donnelly-Weide | |

(Continued)

OTHER PUBLICATIONS

U.S. Appl. No. 29/542,087, filed Oct. 9, 2015, Villarreal et al.

(Continued)

*Primary Examiner* — Kien Nguyen
(74) *Attorney, Agent, or Firm* — Wilson Sonsini Goodrich & Rosati

(57) ABSTRACT

A playground apparatus, extended landing platform attachment, and method of retrofitting a playground structure comprises a slide having at least one inclined surface and a landing platform configured to be coupled to a base of the inclined surface of the slide. The landing platform may be positioned at the base of the slide to enable a user to slide onto the platform from the slide and to move across the platform away from the path of a subsequent user sliding down the inclined surface of the slide. The landing platform may also be configured to provide additional seating area and more points of accessibility to provide easier access to a disabled user using the playground apparatus.

28 Claims, 7 Drawing Sheets

(56) References Cited

U.S. PATENT DOCUMENTS

| | | | | |
|---|---|---|---|---|
| 5,505,663 | A | 4/1996 | Goulart et al. | |
| D371,414 | S | 7/1996 | King | |
| D388,148 | S | 12/1997 | Sutton et al. | |
| 6,569,023 | B1 | 5/2003 | Briggs | |
| 7,494,419 | B2 | 2/2009 | Katz et al. | |
| 8,753,216 | B2 * | 6/2014 | Hsieh | A63G 31/007 472/116 |
| D749,180 | S | 2/2016 | Goldreyer | |
| D752,154 | S | 3/2016 | Wai | |
| 2012/0135813 | A1 | 5/2012 | Parkey et al. | |

OTHER PUBLICATIONS

Notice of Allowance dated Nov. 14, 2016 for U.S. Appl. No. 29/542,087.

Notice of Allowance dated Mar. 13, 2017 for U.S. Appl. No. 29/542,087.

* cited by examiner

METHOD AND APPARATUS FOR PROVIDING DISABLED INDIVIDUALS ACCESS TO PLAYGROUND STRUCTURES

CROSS-REFERENCE

The present application is a continuation in part, and claims the benefit of U.S. patent application Ser. No. 29/542,087, filed Oct. 9, 2015, the entire contents of which are incorporated herein by reference.

BACKGROUND OF THE INVENTION

The method and apparatus described below relate generally to providing disabled individuals access to playground structures, although this is not intended to be limiting and usage by non-disabled individuals is also contemplated.

The 2010 Americans with Disabilities Act (ADA) requires public playgrounds to be designed and constructed in such a manner that the playground equipment is readily accessible to and usable by individuals with disabilities. The ADA also provides that alterations that affect or could affect the usability of playground equipment must be performed in such a manner that the altered portion is readily accessible to and usable by the disabled. Accordingly, there is a need for a method and apparatus that are structurally practicable in conformance with ADA standards to provide disabled individuals access to playground structures.

At least some of these objectives will be met by the exemplary embodiments described herein.

SUMMARY OF THE INVENTION

Aspects of the present disclosure provide a method and apparatus for a playground structure and for altering a playground structure to provide access to a disabled user.

In a first aspect of the present disclosure, a landing platform providing access to a disabled user to exit from an inclined surface of a slide comprises an elongate member having a front, a back, a bottom, two sides, and a top comprising a substantially planar top surface. The slide has a bottom edge formed at a base of the inclined surface, wherein the bottom edge has a predetermined base width. The top surface of the elongate member has a width and a depth. The width is taken to be the distance across the top surface along a latitudinal axis that runs from one side to the other side of the elongate member, wherein the latitudinal axis is substantially parallel to the top front and top back edges of the platform. The depth is taken to be the distance across the top surface along a longitudinal axis that runs from the front to the back of the elongate member, wherein the longitudinal axis is substantially perpendicular to the latitudinal axis. The width of the top surface is greater than the predetermined base width of the bottom edge formed at the base of the inclined surface of the slide. The platform is configured to be coupled to the base of the inclined surface of the slide to enable the user to slide onto the top surface of the platform upon leaving the inclined surface and move to a side portion of the platform away from the path of a subsequent user sliding down the inclined surface.

The landing platform may comprise at least one supporting member configured to support the elongate member and the weight of one or more users sliding or moving onto the platform. The supporting member may be the elongate member or may be part of the elongate member.

The landing platform may comprise at least one rounded edge on the front of the elongate member that is configured to promote a sliding motion of the user across the platform. The rounded edge may extend along a border where the front meets the top surface of the elongate member. The landing platform may further comprise at least one handle configured to assist the user into a wheelchair or to assist the user to otherwise leave the platform.

The elongate member of the landing platform may comprise a substantially rectangular shape. The elongate member may further comprise at least one rounded corner. The width of the top surface may be at least approximately twice the predetermined base width. In a preferable embodiment, the width of the top surface may be at least approximately four times the depth of the top surface.

The landing platform may be configured to be coupled to the base of the inclined surface of the slide in a position that is offset to one side with respect to the base of the inclined surface of the slide. As an alternative, the platform may be configured to be coupled to the base in a position that is substantially centered with respect to the base of the inclined surface of the slide. The landing platform may further be configured to be coupled to the base of the inclined surface such that the base is inset with respect to the platform, wherein a portion of the platform is configured to extend on at least one side and behind the base of the inclined surface to allow a user access to the platform from a side or from the back of the platform.

In another aspect of the present invention, a method of retrofitting a slide to provide access to a disabled user comprises providing a slide having an inclined surface and a bottom edge formed at a base of the inclined surface and providing a landing platform comprising an elongate member having a front, a back, a bottom, two sides, and a top comprising a substantially planar top surface. The bottom edge of the inclined surface of the slide has a predetermined base width and the top surface of the elongate member of the platform has a width and a depth. The width is taken to be the distance across the top surface along a latitudinal axis that runs from one side to the other side of the elongate member, wherein the latitudinal axis is substantially parallel to the top front and top back edges of the platform. The depth is taken to be the distance across the top surface along a longitudinal axis that runs from the front to the back of the elongate member, wherein the longitudinal axis is substantially perpendicular to the latitudinal axis. The width of the top surface is greater than the predetermined base width of the bottom edge. The method further comprises coupling the elongate member to the base of the inclined surface to provide an extended landing platform.

The platform has additional seating area to support the weight of a user leaving the inclined surface and to enable the user to move to a side portion of the platform away from the path of a subsequent user sliding down the inclined surface. In a preferable embodiment, the width of the top surface may be at least approximately four times the depth of the top surface.

The method may further comprise supporting the elongate member with at least one supporting member configured to support the elongate member and the weight of one or more users on the platform. The supporting member may be the elongate member or may be part of the elongate member.

The width of the top surface of the elongate member may be at least approximately twice the predetermined base width and coupling the landing platform to the base of the inclined surface of the slide may comprise positioning the platform so that it is offset to one side with respect to the base of the inclined surface. As an alternative, coupling the landing platform to the base of the inclined surface may comprise positioning the platform so that it is substantially centered with respect to the base of the inclined surface. Coupling the landing platform to the base may further comprise positioning the platform such that the base is inset with respect to the platform, wherein a portion of the platform is positioned to extend on at least one side and behind the base of the inclined surface to allow a user access to the platform from a side or from the back of the platform.

The landing platform may comprise at least one handle configured to assist the user into a wheelchair or to assist the user to otherwise exit the platform.

In still another aspect of the present invention, a playground apparatus accessible to a disabled user comprises a slide having at least one inclined surface, a bottom edge formed at a base of the inclined surface, and a landing platform comprising an elongate member having a front, a back, a bottom, two sides, and a top having a substantially planar top surface. The bottom edge of the inclined surface of the slide has a predetermined base width and the top surface of the elongate member of the platform has a width and a depth. The width is taken to be the distance across the top surface along a latitudinal axis that runs from one side to the other side of the elongate member, wherein the latitudinal axis is substantially parallel to the top front and top back edges of the platform. The depth is taken to be the distance across the top surface along a longitudinal axis that runs from the front to the back of the elongate member, wherein the longitudinal axis is substantially perpendicular to the latitudinal axis. The width of the top surface is greater than the predetermined base width of the bottom edge. The apparatus further comprises a landing platform that is positioned at the base of the inclined surface to enable the user to slide onto the top surface of the elongate member of the platform upon leaving the inclined surface of the slide and to move to a side portion of the platform away from the path of a subsequent user sliding down the inclined surface of the slide.

The playground apparatus may further comprise at least one supporting member configured to support the elongate member and the weight of one or more users on the platform. The supporting member may be the elongate member or may be part of the elongate member.

The elongate member of the platform may comprise a substantially rectangular shape. The elongate member may further comprise at least one rounded corner. The front of the elongate member may further comprise at least one rounded edge configured to promote a sliding motion of the user across the platform. The rounded edge may extend along a border where the front meets the top surface of the elongate member. The width of the top surface of the elongate member may be at least approximately twice the predetermined base width. In a preferable embodiment, the width of the top surface may be at least approximately four times the depth of the top surface.

The landing platform may be offset to one side with respect to the base of the inclined surface of the slide or the landing platform may be substantially centered with respect to the base of the inclined surface of the slide. The landing platform may be coupled to the base of the inclined surface such that the base is inset with respect to the platform, wherein a portion of the platform is configured to extend on at least one side and behind the base of the inclined surface to allow a user access to the platform from a side or from the back of the platform. The landing platform may comprise at least one handle configured to assist the user into a wheelchair or to assist the user to otherwise exit the platform.

The slide of the playground apparatus may further comprise at least one sidewall that extends along a length of the inclined surface.

These and other embodiments are described in further detail in the following description related to the appended figures.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

The method and apparatus as disclosed herein are suited for use with any slide comprising an inclined surface. A landing platform may be provided which may provide access to a disabled user to exit from the slide. The landing platform may be arranged substantially transverse to the slide, so that a user may exit from the slide onto the landing platform and then move in a lateral direction to get out of the path of the slide. This may advantageously provide the user with extra time to remove him or herself from the vicinity of the slide, while allowing other users to continue using the slide.

Figure 1:
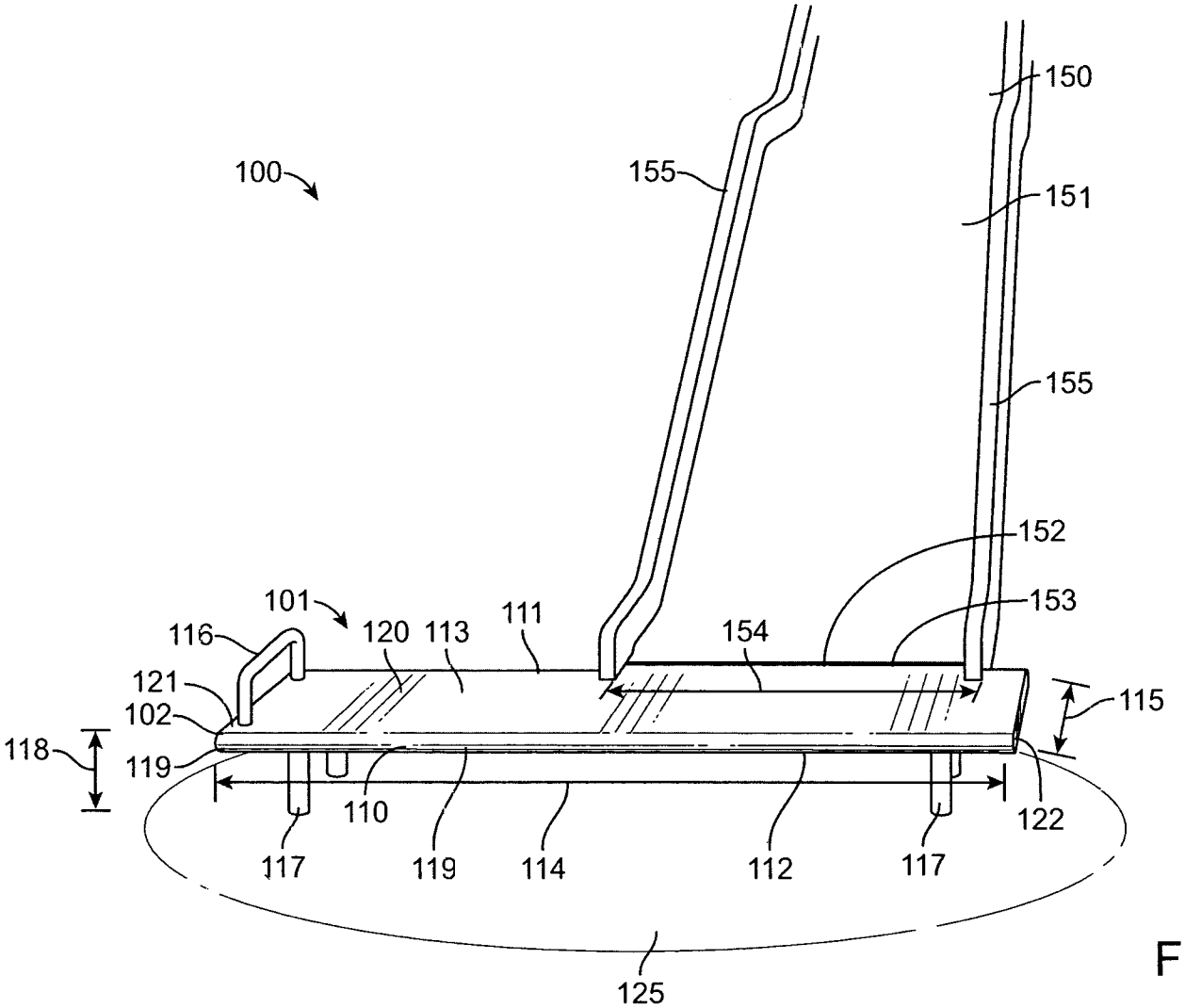
FIG. 1 shows a perspective view of an exemplary embodiment of a playground apparatus accessible to a disabled user having an extended landing platform comprising four supporting members and a support handle.

FIG. 1 shows a perspective view of an exemplary embodiment of a playground apparatus 100 accessible to a disabled user, wherein the apparatus comprises an extended landing platform 101 comprising four supporting members 117 and a support handle 116. The playground apparatus 100 further comprises a slide 150 having at least one inclined surface 151, a bottom edge 152 formed at a base 153 of the inclined surface, and a landing platform 101 comprising an elongate member 102 having a front 110, a back 111, a bottom 112, two sides 121 and 122, and a top having a substantially planar top surface 113.

The bottom edge of the inclined surface of the slide has a predetermined base width 154 and the top surface of the elongate member of the landing platform has a width 114 and a depth 115. The width 114 of the landing platform is taken to be the distance across the top surface 113 along a latitudinal axis that runs from one side to the other side of the elongate member, wherein the latitudinal axis is substantially parallel to the top front and top back edges of the platform. The depth 115 of the landing platform is taken to be the distance across the top surface 113 along a longitudinal axis that runs from the front to the back of the elongate member, wherein the longitudinal axis is substantially perpendicular to the latitudinal axis. The width of the landing platform may be greater than the depth of the landing platform. The width of the landing platform may be greater than the depth of the landing platform by at least 5%, 10%, 25%, 50%, 75%, 100%, 150%, 250%, 300%, 400%, or 500%. Elongate member of the landing platform may be oriented to be transverse to the slide. For instance, the width of the landing platform may be substantially perpendicular to an axis extending along a length of the slide. The width of the landing platform may be substantially orthogonal to a direction of motion of a user coming down a slide. An angle between the width of the landing platform and the axis extending along a length of the slide or direction of motion of a user coming down a slide may be greater than at least 45, 60, 75, 85, 88, 90, 92, 95, 105, 120, or 135 degrees. The angle may be less than any of the degree values listed or may fall within a range between any two of the degree values listed.

The width 114 of the top surface may be greater than the predetermined base width 154 of the bottom edge. The width of the top surface may be greater than the predetermined base width by at least 5%, 10%, 25%, 50%, 75%, 100%, 150%, 200%, 250%, 300%, 400%, or 500%. Similarly, the width of the landing platform may be at least 1.3 times, 1.5 times, 1.7 times, 2 times, 2.5 times, 3 times, 4 times, or 5 times the base width of the bottom edge of the slide. The width of the top surface may extend beyond the predetermined base width by at least 20 cm, 30 cm, 40 cm, 50 cm, 60 cm, 70 cm, 80 cm, 90 cm, 100 cm, 120 cm, 150 cm, 175 cm, 200 cm, 250 cm, 300 cm, or 500 cm. The width of the top surface extending beyond the predetermined base width may be sufficiently great to allow a user or two users to sit on the top surface without coming into the path of other users sliding down the slide. The width of the top surface extending beyond the predetermined base width may be sufficiently great to allow a user or two users to sit on the top surface without interfering with a path of other users sliding down the slide. The width of the top surface extending beyond the predetermined base width may be sufficient to allow a wheelchair to be placed along the top surface without coming into the path of the slide, or any other users sliding down the slide. The width may be sufficiently great to accommodate any standard wheelchair width (e.g., approximately 26 inches for adult wheelchair width, 32 inches to meet ADA standards for wheelchair doorway clearance).

The landing platform is positioned at the base of the inclined surface to enable the user to slide onto the top surface 113 of the elongate member of the platform upon leaving the inclined surface of the slide and to move to a side portion 120 of the platform away from the path of a subsequent user sliding down the inclined surface of the slide. The side portion may have a width of at least 20 cm, 30 cm, 40 cm, 50 cm, 60 cm, 70 cm, 80 cm, 90 cm, 100 cm, 120 cm, 150 cm, 175 cm, 200 cm, 250 cm, 300 cm, or 500 cm. The width of the side portion may be sufficiently great to allow a user or two users to sit on the top surface without coming into the path of other users sliding down the slide. The width of the side portion may be sufficiently great to allow a user or two users to sit on the top surface without interfering with a path of other users sliding down the slide. The width of the side portion may be sufficient to allow a wheelchair to be placed along the top surface without coming into the path of the slide, or any other users sliding down the slide.

A side portion of the platform may be positioned to the right of the slide when facing the slide, to the left of the slide when facing the slide, or both the right side and the left side of the slide when facing the slide. If side portions are provided on both the right and the left side of the slide, each of the slide portions may have the same characteristics or different characteristics. In one example, one of the side portions may have a greater width than the other side portion. For instance, one or the side portions may be designed to accommodate a user that may be resting on the landing platform, while the other side may not be sufficiently wide to accommodate the user. A side that may not be sufficiently wide to accommodate a user may be provided as buffer to prevent a user from sliding off accidentally to the side after exiting the slide. Alternatively, both sides may have the same width. Any of the side portions (e.g., on the left side only, on the right side only, or both the left and right side) may have any the characteristics described, such as the dimensions.

The landing platform may have a depth 115. The depth may be sufficient to allow a user to sit on the landing platform, but not so great that the user becomes stuck. In some instances, the depth may be greater than about 10 cm, 20 cm, 25 cm, 30 cm, 35 cm, 40 cm, 45 cm, 50 cm, or 60 cm. Optionally, the depth may be less than about 20 cm, 25 cm, 30 cm, 35 cm, 40 cm, 45 cm, 50 cm, 60 cm, 70 cm, or 80 cm. The depth of the landing platform may be selected based on an angle of incline for the slide. For instance, a steeper slide may require a greater depth to give a user more time to slow down, and reduce a likelihood of a user falling off the landing platform. The depth may also be selected based on a material that is used to form the landing platform. For instance, if a top surface of a landing platform has a greater frictional coefficient, the depth may not need to be as great as when the top surface of the landing platform has a lesser frictional coefficient.

The landing platform may be formed of any material. The landing platform may be formed from a plastic or polymer-based material. The landing platform may be formed from a metal. The material that is used in the top portion of the landing platform may affect the frictional coefficient of the landing platform, which may in turn affect the depth of the landing platform. The top surface of the landing platform may have a smooth-finished surface or may include a textured or rough surface. The finish of the top surface also affect its frictional coefficient. The top surface may be formed from a single material uniformly across its surface or may include different materials at different points along the width of the landing platform. The elongate member of the landing platform may be formed from a single integral piece or multiple pieces connected together.

As shown in FIG. 1, the elongate member 102 may comprise a substantially rectangular shape. In a preferable embodiment, the width of the top surface 114 may be at least approximately twice the predetermined base width 154 and the width of the top surface 114 may be at least approximately four times the depth of the top surface 115. The elongate member may have any other substantially elongated shape. For instance, the elongate member may form a trapezoid, parallelogram, oval, ellipse, hexagon, or any other shape.

The landing platform may be configured to be coupled to the base of the inclined surface of the slide in a position that is offset to one side with respect to the base of the inclined surface of the slide. This configuration allows for an expanded landing platform with sufficient space on the side portion 120 for a user to move across the platform away from the path of a subsequent user sliding down the slide. The landing platform may further comprise at least one rounded edge 119 on the front 110 that may extend along a border where the front meets the top surface 113 of the elongate member. The rounded edge may be configured to promote a sliding motion of the user across the platform away from the path of a subsequent user sliding down the slide.

The platform may further comprise at least one handle 116, shown disposed near the edge of a side 121 of the platform that is furthest from the path of a subsequent user sliding down the slide. The handle may be configured to assist the user into a wheelchair or to assist the user to otherwise leave the platform once the user has moved across the platform after sliding down the slide. Alternatively, additional handles may be provided, or may be located at different locations along the landing platform.

The four supporting members 117 may be cylindrical in shape and may be disposed beneath the elongated member and positioned near the edges of the two sides 121 and 122, as shown in FIG. 1. The supporting members may be configured to support both the elongate member and the weight of any users on the platform. Any number or configuration of supporting members may be provided. For instance, the supporting members may include one or more posts, blocks, trusses, walls, or other types of shapes that may allow the elongated member to be elevated above the ground. One or more supporting members may be integrally formed with the elongated member or may be separately attached to the elongated member.

The landing platform may have a height 118. The one or more supports may cause the top surface of the landing platform to be at a height above an underlying surface. The landing platform may match the height of the base of the slide. In some embodiments, the height of the landing platform may remain the same along the width of the landing platform. The height of the landing platform may be greater than, less than, or equal to the depth of the landing platform. The height of the landing platform may be greater than or equal to about 10 cm, 20 cm, 30 cm, 40 cm, 50 cm, 60 cm, 70 cm, or 80 cm. The height of the landing platform may be less than or equal to about 20 cm, 30 cm, 40 cm, 50 cm, 60 cm, 70 cm, 80 cm, 90 cm, or 100 cm. The height of the landing platform may be close to a height of a wheelchair or may allow a user to transfer to a wheelchair without much difficulty. The height of the landing platform may be greater than the height of a wheelchair, less than the height of a wheelchair, or about equal to a height of the wheelchair (e.g., about 19 inches seat height for a standard wheelchair, or any other known dimension for a pediatric wheelchair). The height of the landing platform may be within 1 cm, 3 cm, 5 cm, 10 cm, 15 cm, 20 cm, or 30 cm, of the height of a seat of a wheelchair.

One or more handles on the landing platform may be at a height that may allow for easy transfer of a user to a wheelchair. The handle may have a height that is similar to a height of a wheelchair armrest (e.g., about 30 inches for standard wheelchair, or any other known dimension for a pediatric wheelchair) or a wheelchair seat (e.g., about 19 inches for standard wheelchair, or any other known dimension for a pediatric wheelchair). The height of the handle (e.g., top surface of the handle relative to the underlying ground) may be within about 1 cm, 3 cm, 5 cm, 10 cm, 15 cm, 20 cm, or 30 cm, of the height of an armrest of the wheelchair or a seat of a wheelchair.

A ground pad 125 may be disposed beneath the landing platform to provide a more cushioned or higher friction surface for a user to step upon after exiting the platform. The ground pad may extend laterally relative to the landing platform. For instance, the ground pad may extend by at least 10 cm, 20 cm, 30 cm, 40 cm, 50 cm, 75 cm, 100 cm, 150 cm, or 200 cm away from landing platform in a single direction or multiple directions. The ground pad may include an elastomeric or soft material. For instance, the ground pad may include rubber, polymer, or any other types of resilient materials. The supporting members may rest on the ground pad, or may extend through the ground pad.

As illustrated, a slide may optionally have one or more side guards 155. The side guards may extend above an inclined surface 151 and may prevent a user from sliding off the side edge of the slide. Optionally a pair of side guards may be provided on both sides of the slide. A base width may optionally be a distance between the pair of side guards. The base width may or may not include the widths of the side guards themselves. The side guards may or may not extend over a portion of a top surface of the landing platform. In some instances, the side guards may end before the landing platform or at an edge of the landing platform. Alternatively, the side guards may extend to cover at least a portion of the top surface of the landing platform.

The slide may have a base 153 that may gradually reduce the level of incline so that the slide may transition relatively smoothly to the landing platform. This may prevent a user from experiencing a rough transition from the slide to the landing platform. The degree of incline may be greater at a top of a slide than the base of the slide. The change in angle from the base of the base of the slide to the top surface of the landing platform may be less than or equal to about 25 degrees, 20 degrees, 15 degrees, 10 degrees, 5 degrees, 3 degrees, or 1 degree.

Figure 2:
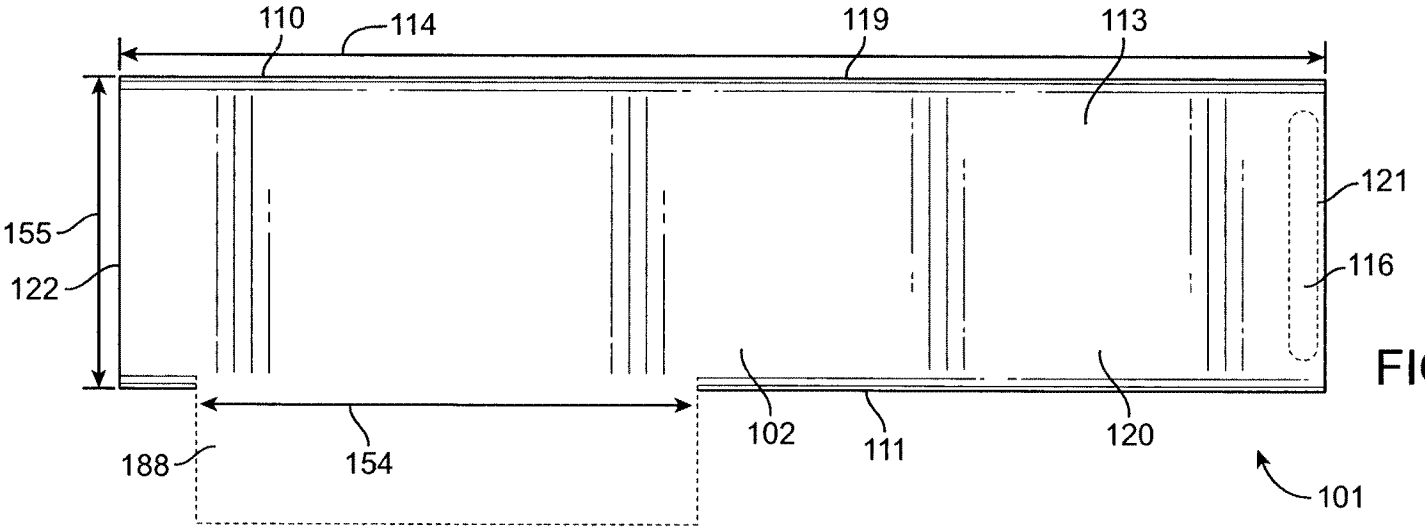
FIG. 2 shows a top view of the extended landing platform of FIG. 1.
Figure 3:
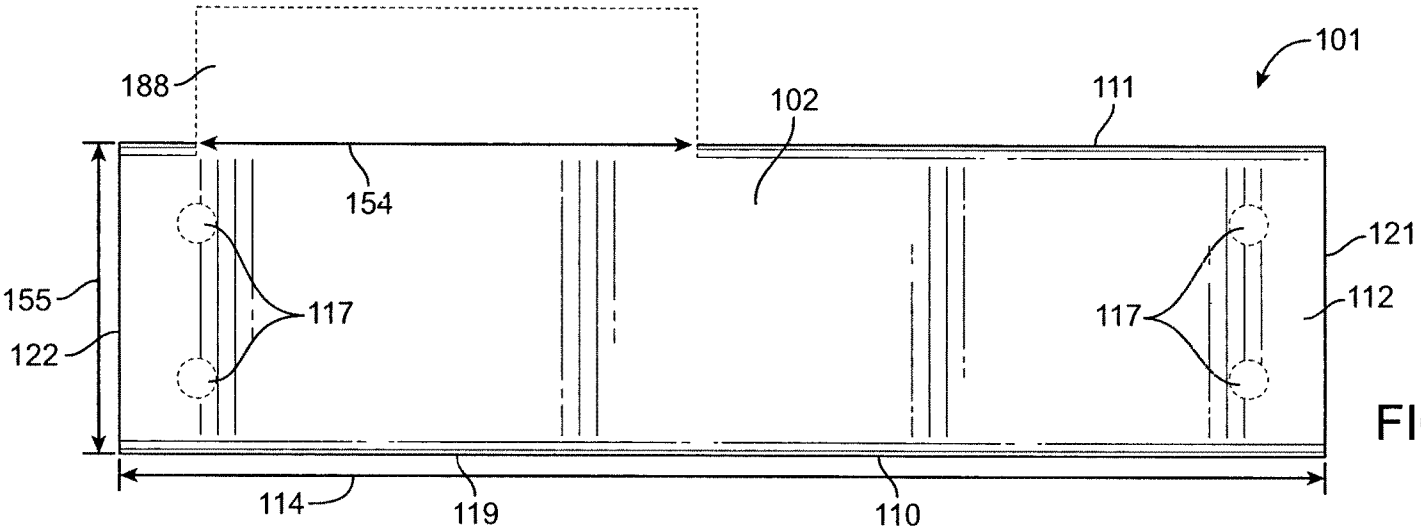
FIG. 3 shows a bottom view of the extended landing platform of FIG. 1.
Figure 5:
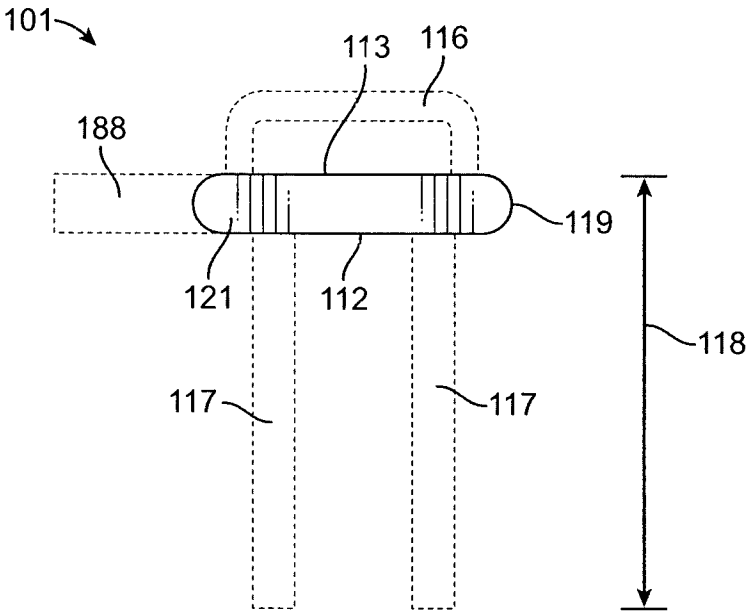
FIGS. 4 and 5 show a view from each side of the extended landing platform of FIG. 1.
Figure 4:
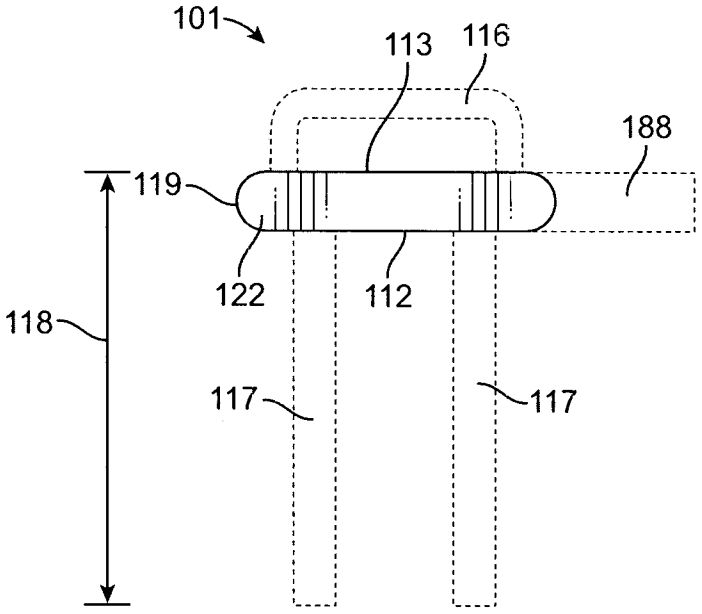
Figure 6:
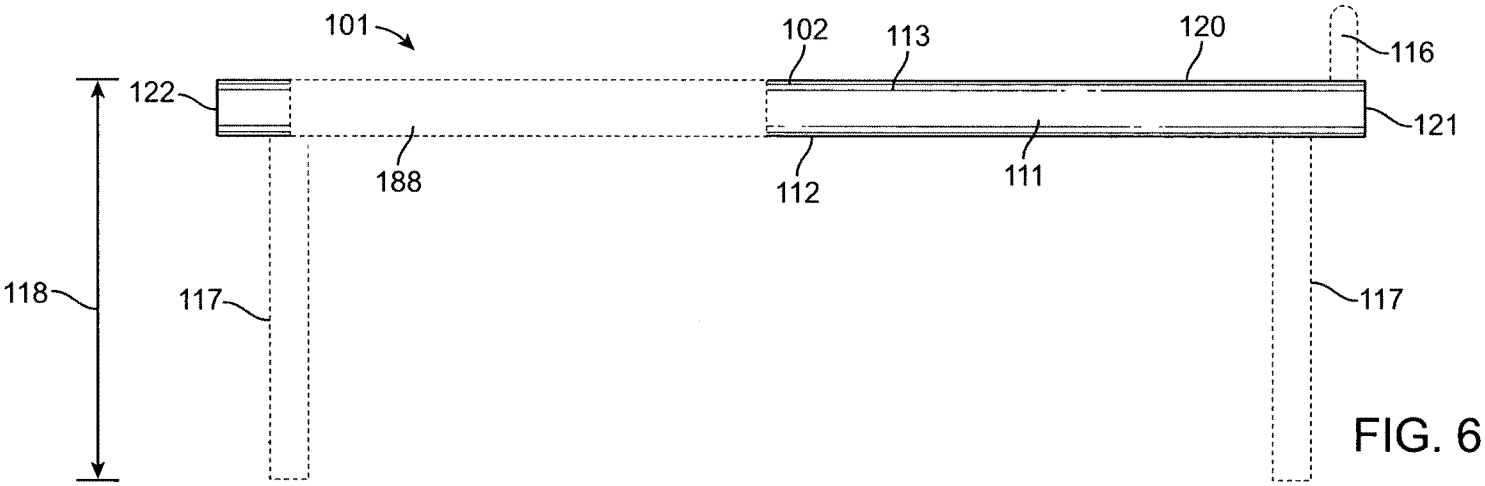
FIG. 6 shows a back view of the extended landing platform of FIG. 1.
Figure 7:
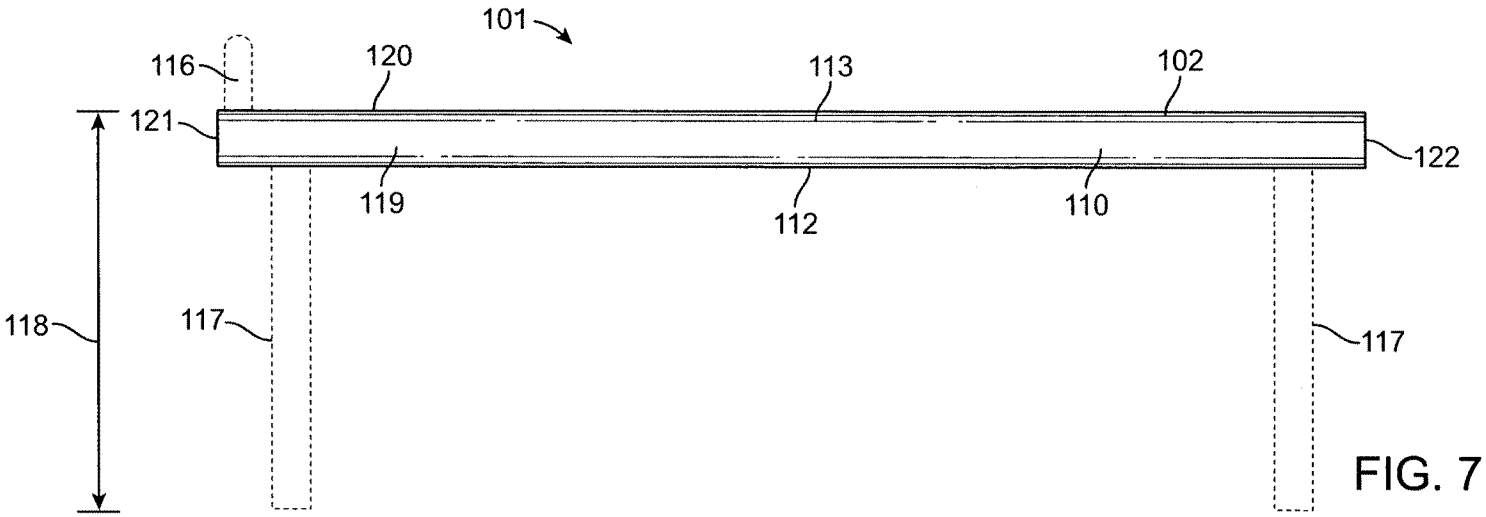
FIG. 7 shows a front view of the extended landing platform of FIG. 1.

FIGS. 2 and 3 show a top and bottom view respectively of the extended landing platform of FIG. 1, while FIGS. 4 and 5 show a view from each side of the extended landing platform of FIG. 1. FIGS. 6 and 7 show a back and front view respectively of the extended landing platform of FIG. 1.

As shown in FIGS. 2-6, a landing platform may optionally comprise an engagement member 188 to facilitate engagement, coupling, or attachment to the base or the bottom of the inclined surface of the slide. The engagement member may be substantially flush with the back of the landing platform or may protrude from the back of the landing platform. The engagement member may protrude about 1 cm, 3 cm, 5 cm, 10 cm, 15 cm, 20 cm, or 30 cm from the back of the landing platform.

The engagement member may comprise a substantially planar surface and may be substantially flat or inclined at an angle with respect to the top surface of the landing platform to facilitate engagement with the base or the bottom of the inclined surface of the slide. The engagement member may have a width and a depth. The width of the engagement member may be about the same as the predetermined base width 154, or it may be longer or shorter. The depth of the engagement member may substantially coincide with how far the engagement member protrudes from the back of the landing platform. The angle between the depth of the landing platform (i.e. the longitudinal axis of the platform) and an axis extending across a depth of the engagement member (i.e. the angle at which the engagement member is inclined) may be less than or equal to about 25 degrees, 20 degrees, 15 degrees, 10 degrees, 5 degrees, 3 degrees, or 1 degree.

Figure 8:
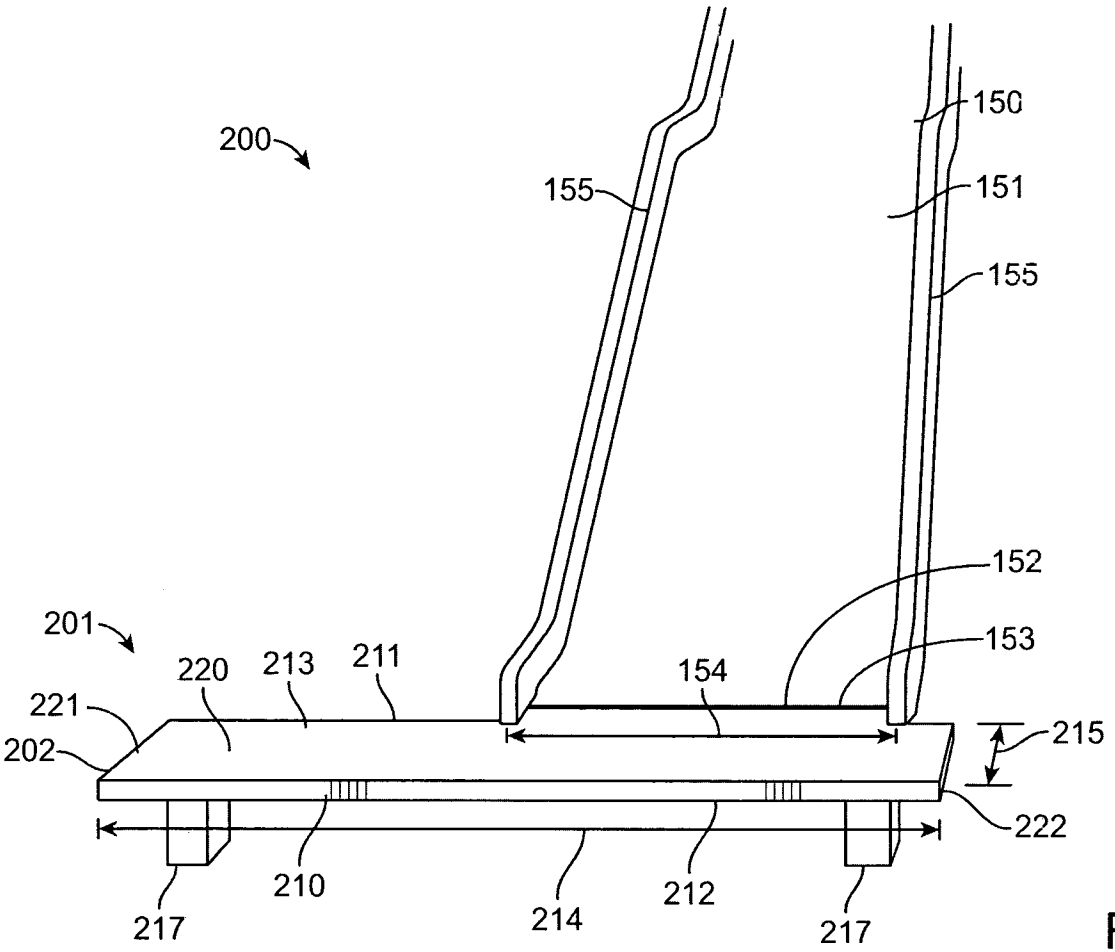
FIG. 8 shows a perspective view of an exemplary embodiment of a playground apparatus accessible to a disabled user having an extended landing platform comprising two supporting members.

FIG. 8 shows a perspective view of an exemplary embodiment of a playground apparatus 200 accessible to a disabled user, wherein the apparatus comprises an extended landing platform 201 comprising two supporting members 217. The playground apparatus 200 comprises a slide 150 having at least one inclined surface 151, a bottom edge 152 formed at a base 153 of the inclined surface, and a landing platform 201 comprising an elongate member 202 having a front 210, a back 211, a bottom 212, two sides 221 and 222, and a top having a substantially planar top surface 213. The bottom edge of the inclined surface of the slide has a predetermined base width 154 and the top surface of the elongate member of the landing platform has a width 214 and a depth 215. The width 214 is taken to be the distance across the top surface 213 along a latitudinal axis that runs from one side to the other side of the elongate member, wherein the latitudinal axis is substantially parallel to the top front and top back edges of the platform. The depth 215 is taken to be the distance across the top surface 213 along a longitudinal axis that runs from the front to the back of the elongate member, wherein the longitudinal axis is substantially perpendicular to the latitudinal axis. The width 214 of the top surface is greater than the predetermined base width 154 of the bottom edge. The landing platform is positioned at the base of the inclined surface to enable the user to slide onto the top surface 213 of the elongate member of the platform upon leaving the inclined surface of the slide and to move to a side portion 220 of the platform away from the path of a subseqtient user sliding down the inclined surface of the slide.

As shown in FIG. 8, the elongate member 102 may comprise a substantially rectangular shape. The two supporting members 217 may each also have a substantially rectangular shape and may be disposed beneath the elongated member and positioned near the edges of the two sides 221 and 222, as shown in FIG. 8. The supporting members may be configured to support both the elongate member and the weight of any users on the platform.

The landing platform may be configured to be coupled to the base of the inclined surface of the slide in a position that is offset to one side with respect to the base of the inclined surface of the slide. In a preferable embodiment, the width of the top surface 214 may be at least approximately twice the predetermined base width 154 and the width of the top surface 214 may be at least approximately four times the depth of the top surface 215. This configuration allows for an expanded landing platform with sufficient space on the side portion 220 for a user to move across the platform away from the path of a subsequent user sliding down the slide.

Figure 9:
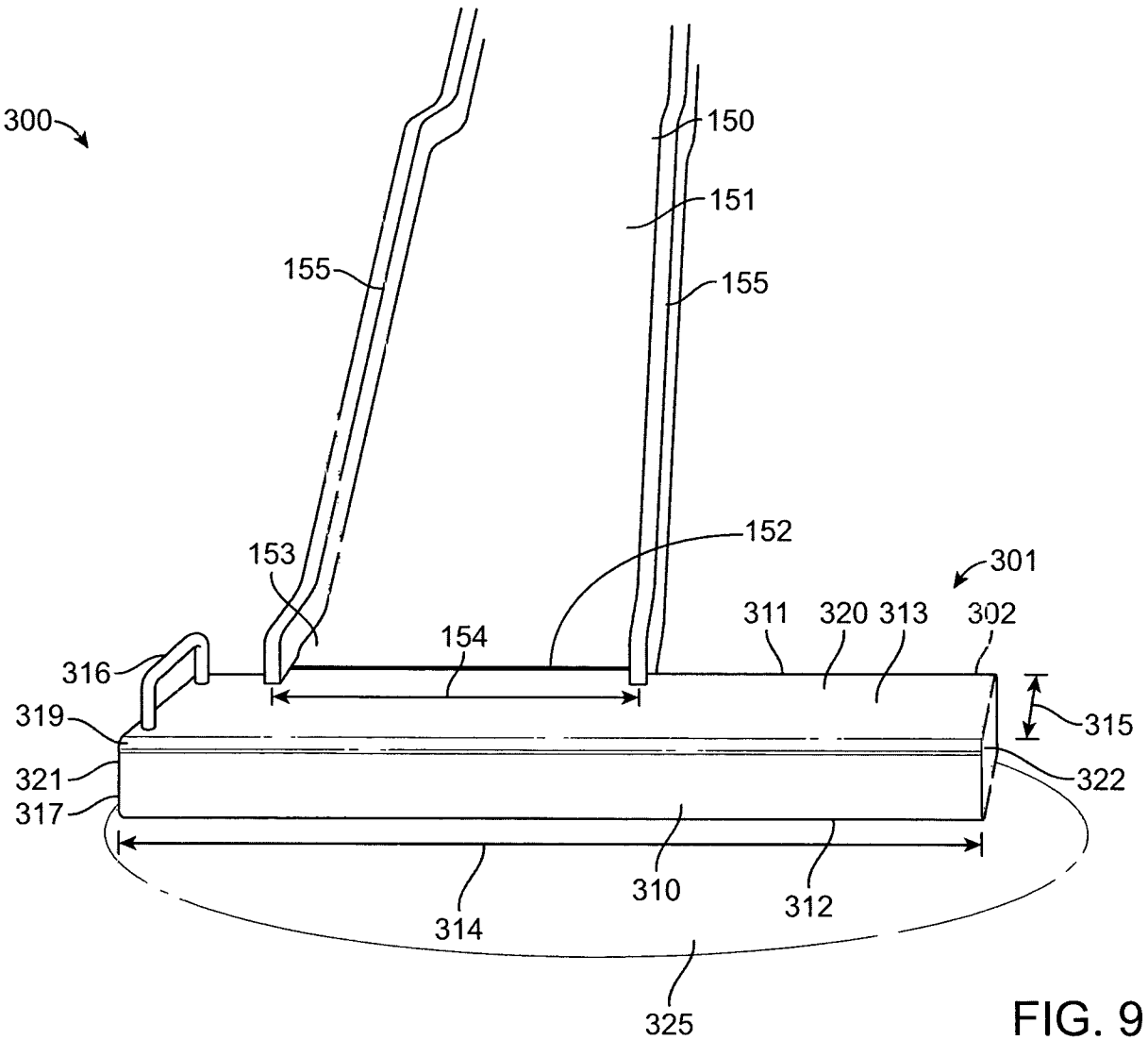
FIG. 9 shows a perspective view of an exemplary embodiment of a playground apparatus accessible to a disabled user having an extended landing platform comprising one supporting member and a support handle.

FIG. 9 shows a perspective view of an exemplary embodiment of a playground apparatus 300 accessible to a disabled user, wherein the apparatus comprises an extended landing platform 301 comprising one supporting member 317 and a support handle 316. The playground apparatus 300 comprises a slide 150 having at least one inclined surface 151, a bottom edge 152 formed at a base 153 of the inclined surface, and a landing platform 301 comprising an elongate member 302 having a front 310, a back 311, a bottom 312, two sides 321 and 322 and a substantially planar top surface 313. The bottom edge of the inclined surface of the slide has a predetermined base width 154 and the top surface of the elongate member of the landing platform has a width 314 and a depth 315. The width 314 is taken to be the distance across the top surface 313 along a latitudinal axis that runs from one side to the other side of the elongate member, wherein, the latitudinal axis is substantially parallel to the top front and top back edges of the platform. The depth 315 is taken to be the distance across the top surface 313 along a longitudinal axis that runs from the front to the back of the elongate member, wherein the longitudinal axis is substantially perpendicular to the latitudinal axis. The width 314 of the top surface is greater than the predetermined base width 154 of the bottom edge. The landing platform is positioned at the base of the inclined surface to enable the user to slide onto the top surface 313 of the elongate member of the platform upon leaving the inclined surface of the slide and to move to a side portion 320 of the platform away from the path of a subsequent user sliding down the inclined surface of the slide.

As shown in FIG. 9, the elongate member 302 may comprise a substantially rectangular shape. In a preferable embodiment, the width of the top surface 314 may be at least approximately twice the predetermined base width 154 and the width of the top surface 314 may be at least approximately four times the depth of the top surface 315.

The landing platform may be configured to be coupled to the base of the inclined surface of the slide in a position that is offset to one side with respect to the base of the inclined surface of the slide. This configuration allows for an expanded landing platform with sufficient space on the side portion 320 for a user to move across the platform away from the path of a subsequent user sliding down the slide. The landing platform may further comprise at least one rounded edge 319 on the front 310 that may extend along a border where the front meets the top surface 313 of the elongate member. The rounded edge may be configured to promote a sliding motion of the user across the platform away from the path of a subsequent user sliding down the slide.

The platform may further comprise at least one handle 316 disposed near an edge of the platform on the side 321 closest to the base of the inclined surface of the slide. As shown in FIG. 9, the handle may be positioned and configured to assist the user to exit the platform immediately after sliding down the slide and moving onto the top surface 313 without having to slide across to the other side 322 (i.e. to the side portion 320) in order to exit the platform.

In a preferable embodiment, the supporting member 317 may be the elongate member itself. The elongate member may be resting and supported by the ground and may be configured to support the weight of any users on the platform. A ground pad 325 may be disposed beneath the landing platform to provide a more cushioned or higher friction surface for a user to step upon after exiting the platform.

Figure 10:
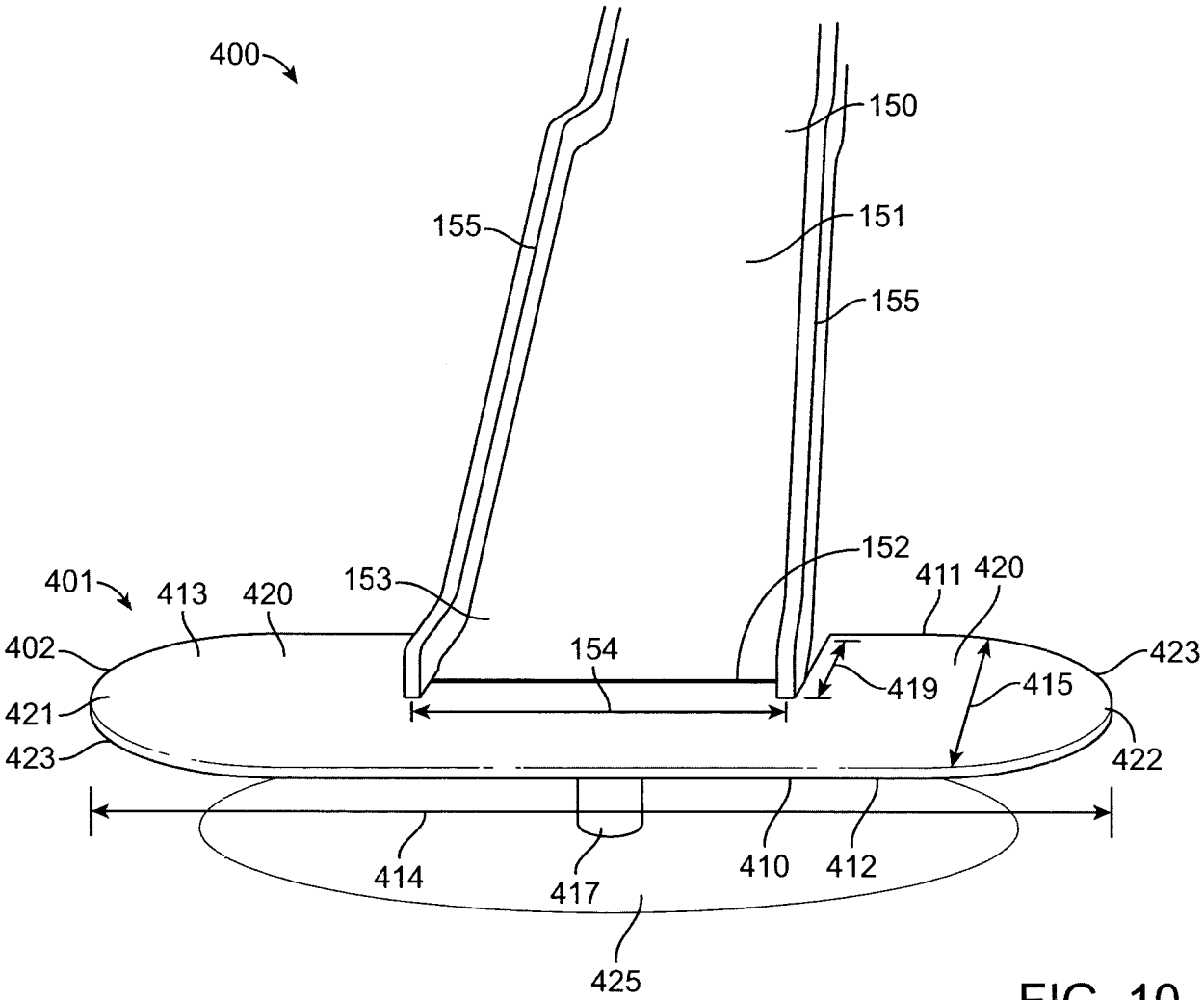
FIG. 10 shows a perspective view of an exemplary embodiment of a playground apparatus accessible to a disabled user having an extended landing platform in a substantially centered position with respect to the base of the slide.

FIG. 10 shows a perspective view of an exemplary embodiment of a playground apparatus 400 accessible to a disabled user, wherein the apparatus comprises an extended landing platform 401 in a substantially centered position with respect to the base of the slide. The playground apparatus 400 comprises a slide 150 having at least one inclined surface 151, a bottom edge 152 formed at a base 153 of the inclined surface, and a landing platform 401 comprising an elongate member 402 having a front 410, a back 411, a bottom 412, two sides 421 and 422, and a top having substantially planar top surface 413. The bottom edge of the inclined surface of the slide has a predetermined base width 154 and the top surface of the elongate member of the landing platform has a width 414 and a depth 415. The width 414 is taken to be the distance across the top surface 413 along a latitudinal axis that runs from one side to the other side of the elongate member, wherein the latitudinal axis is substantially parallel to the top front and top back edges of the platform. The depth 415 is taken to be the distance across the top surface 413 along a longitudinal axis that runs from the front to the back of the elongate member, wherein the longitudinal axis is substantially perpendicular to the latitudinal axis. The width 414 of the top surface is greater than the predetermined base width 154 of the bottom edge. The landing platform is positioned at the base of the inclined surface to enable the user to slide onto the top surface 413 of the elongate member of the platform upon leaving the inclined surface of the slide and to move to a side portion 420 of the platform away from the path of a subsequent user sliding down the inclined surface of the slide.

As shown in FIG. 10, the landing platform may comprise at least one rounded edge 423 on a corner of the elongated member. In a preferable embodiment, the corners of the elongated member are rounded forming two semi-circle shaped platforms on each side 421 and 422 of the elongated member.

The landing platform may be configured to be coupled to the base of the inclined surface of the slide in a position that is substantially centered with respect to the base of the inclined surface of the slide and the width of the top surface 414 may be more than twice the predetermined base width 154. This configuration allows for an expanded landing platform with sufficient space on each side 421 and 422 for a user to move across the platform away from the path of a subsequent user sliding down the slide.

In a preferable embodiment, the base of the inclined surface of the slide may be inset with respect to the platform where it is coupled to the platform, as shown in FIG. 10, to an inset depth of 419. The inset depth is taken to be the distance along an axis from the back of the elongated member to where the bottom edge of the inclined surface meets the top surface of the elongated member, wherein the axis runs substantially perpendicular to the bottom edge and substantially parallel to the direction of a user exiting the inclined surface onto the platform. This configuration allows a portion of the platform to extend not only on one or both sides of the inclined surface but also behind the base of the inclined surface to allow a user to exit or to enter the platform from a side or from the back of the platform. This configuration thus provides greater and easier accessibility to a wheelchair or other device to assist a disabled user to leave the platform after using the slide.

The single supporting member 417 shown in FIG. 10 may be disposed beneath the elongated member in a substantially centered position, and may be cylindrical in shape. The supporting member may be configured to support both the elongate member and the weight of any users on the platform. A ground pad 425 may be disposed beneath the landing platform to provide a more cushioned or higher friction surface for a user to step upon after exiting the platform.

Additionally, various methods of coupling the platform to the base may be employed in practicing the invention. For example, the platform may be coupled to the base of the slide by engaging the base or the bottom edge with at least a portion of the back of the elongate member. The platform may also be coupled to the base by engaging the base with at least a portion of the top or the bottom of the elongate member. The platform may be adhesively or releasably coupled to the base of the inclined surface of the slide using an adhesive, welding, snap-fitting, through engagement elements such as pins or screws, or other methods of adhesion or binding known in the art.

While preferable embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An extended landing platform for providing improved accessibility to and from an inclined surface of a slide structure, the slide structure having a bottom edge formed at a base of the inclined surface of the slide structure, the bottom edge of the slide structure having a predetermined base width, comprising:

an elongate member comprising a front, a back, a bottom, two sides, and a top having a substantially planar top surface, the top surface having a width and a depth, wherein the width of the top surface is wider than the predetermined base width of the bottom edge of the slide structure; and wherein the extended landing platform is configured to be coupled to the base of the inclined surface of the slide structure at an inset depth wherein at least a portion of the extended landing platform extends behind the base of the inclined surface to enable a user to slide onto the top surface upon leaving the inclined surface of the slide structure and move to an extended lateral side portion of the landing platform away from the path of the slide structure and a subsequent user sliding down the inclined surface of the slide structure.

2. The apparatus of claim 1, further comprising at least one supporting member configured to support the elongate member and the weight of one or more users sliding onto the landing platform.

3. The apparatus of claim 2, wherein the supporting member is the elongate member or is part of the elongate member.

4. The apparatus of claim 1, further comprising at least one rounded edge on the front of the elongate member that is configured to promote a sliding motion of the user across the landing platform.

5. The apparatus of claim 1, further comprising at least one handle configured to assist the user into a wheelchair or to assist the user to otherwise leave the landing platform.

6. The apparatus of claim 1, wherein the elongate member comprises a substantially rectangular shape.

7. The apparatus of claim 1, wherein the elongate member comprises at least one rounded corner.

8. The apparatus of claim 1, wherein the width of the top surface is at least approximately twice the predetermined base width.

9. The apparatus of claim 1, wherein the landing platform is configured to be coupled to the base of the inclined surface of the slide structure in a position that is offset to one side with respect to the base of the inclined surface of the slide structure.

10. The apparatus of claim 1, wherein the landing platform is configured to be coupled to the base of the inclined surface of the slide structure in a position that is substantially centered with respect to the base of the inclined surface of the slide structure.

11. The apparatus of claim 1, wherein the portion of the extended landing platform is configured to extend on at least one side and behind the base of the inclined surface of the slide structure to allow a user access to the landing platform from either side or from the back of the landing platform.

12. A method of retrofitting a slide structure to provide impoved accessibility comprising:

providing a slide structure having an inclined surface and a bottom edge formed at a base of the inclined surface of the slide structure, the bottom edge having a predetermined base width;

providing a landing platform comprising an elongate member having a front, a back, a bottom, two sides, and a top having a substantially planar top surface, the top surface having a width and a depth, wherein the width of the top surface is greater in length than the predetermined base width of the bottom edge of the slide structure; and coupling the elongate member to the base of the inclined surface of the slide structure to provide an extended landing platform having additional seating area to support the weight of a user leaving the inclined surface of the slide structure and to enable the user to move to an extended lateral side portion of the landing platform away from the path of a subsequent user sliding down the inclined surface of the slide structure; and further coupling the extended landing platform to the base of the inclined surface of the slide structure further comprises positioning the extended landing platform so that the base is inset with respect to the landing platform, and positioning the extended landing platform so that it extends on at least one side and behind the base of the inclined surface of the slide structure to allow the user access to the extended landing platform from either side or from the back of the extended landing platform.

13. The method of claim 12, further comprising supporting the elongate member with at least one supporting member configured to support the elongate member and the weight of one or more users on the landing platform.

14. The method of claim 13, wherein the at least one supporting member is the elongate member or is part of the elongate member.

15. The method of claim 12, wherein the width of the top surface is at least approximately twice the predetermined base width, and wherein coupling the landing platform to the base of the inclined surface of the slide structure further comprises positioning the landing platform so that it is offset to one side with respect to the base of the inclined surface of the slide structure.

16. The method of claim 12, wherein the width of the top surface is at least approximately twice the predetermined base width, and wherein coupling the landing platform to the base of the inclined surface of the slide structure further comprises positioning the landing platform so that it is substantially centered with respect to the base of the inclined surface of the slide structure.

17. The method of claim 12, wherein the landing platform comprises at least one handle configured to assist the user into a wheelchair or to assist the user to otherwise exit the landing platform.

18. A playground apparatus with improved accessibility comprising:

a slide structure comprising at least one inclined surface having a bottom edge formed at a base of the inclined surface of the slide structure, the bottom edge having a predetermined base width;

an extended landing platform comprising an elongate member having a front, a back, a bottom, two sides, and a top having a substantially planar top surface, the top surface having a width and a depth, wherein the width of the top surface is greater in length than the predetermined base width of the bottom edge of the slide structure; and wherein the extended landing platform is positioned at the base of the inclined surface of the slide structure to enable the user to slide onto the top surface upon leaving the inclined surface of the slide structure and move to an extended lateral side portion of the extended landing platform away from the path of a subsequent user sliding down the inclined surface of the slide structure; and wherein the extended landing platform is configured to be coupled to the base of the inclined surface of the slide structure such that the base is inset with respect to the extended landing platform, wherein a portion of the extended landing platform is configured to extend on at least one side and behind the base of the inclined surface of the slide structure to allow a user access to the extended landing platform from either side or from the back of the landing platform.

19. The apparatus of claim 18, further comprising at least one supporting member configured to support the elongate member and the weight of one or more users on the landing platform.

20. The apparatus of claim 19, wherein the supporting member is the elongate member or is part of the elongate member.

21. The apparatus of claim 18, wherein the front of the elongate member further comprises at least one rounded edge configured to promote a sliding motion of the user across the landing platform.

22. The apparatus of claim 18, wherein the landing platform further comprises at least one handle configured to assist the user into a wheelchair or to assist the user to otherwise exit the landing platform.

23. The apparatus of claim 18, wherein the elongate member comprises a substantially rectangular shape.

24. The apparatus of claim 18, wherein the elongate member comprises at least one rounded corner.

25. The apparatus of claim 18, wherein the width of the top surface is at least approximately twice the predetermined base width.

26. The apparatus of claim 18, wherein the landing platform is offset to one side with respect to the base of the inclined surface of the slide structure.

27. The apparatus of claim 18, wherein the landing platform is substantially centered with respect to the base of the inclined surface of the slide structure.

28. The apparatus of claim 18, wherein the slide structure further comprises at least one sidewall that extends along a length of the inclined surface of the slide structure.

* * * * *